US010104943B2

(12) United States Patent
Haider et al.

(10) Patent No.: US 10,104,943 B2
(45) Date of Patent: Oct. 23, 2018

(54) PULL AND RELEASE LATCH

(71) Applicants: Abbas Haider, Fairfax, VA (US); Robert Imre Davis, Locust Groove, VA (US); Robert Michael Romano, Spring, TX (US); Daniel Isaac Armstrong, Roanoke, VA (US); Daniel Edgar Nelson, Louisville, KY (US)

(72) Inventors: Abbas Haider, Fairfax, VA (US); Robert Imre Davis, Locust Groove, VA (US); Robert Michael Romano, Spring, TX (US); Daniel Isaac Armstrong, Roanoke, VA (US); Daniel Edgar Nelson, Louisville, KY (US)

( * ) Notice: Subject to any disclaimer, the term of this patent is extended or adjusted under 35 U.S.C. 154(b) by 483 days.

(21) Appl. No.: 14/324,323

(22) Filed: Jul. 7, 2014

(65) Prior Publication Data

US 2016/0000191 A1 Jan. 7, 2016

(51) Int. Cl.

| | |
|---|---|
| ***A44B 11/25*** | (2006.01) |
| ***F16B 45/02*** | (2006.01) |
| ***F41H 1/02*** | (2006.01) |
| ***A44B 11/22*** | (2006.01) |

(52) U.S. Cl.
CPC ..... *A44B 11/2592* (2013.01); *F16B 45/025* (2013.01); *F41H 1/02* (2013.01)

(58) Field of Classification Search
CPC ..... A44B 11/263; A44B 11/2542; A44B 11/2592; Y10T 24/45529; Y10T 24/45581; Y10T 24/45241; Y10T 24/45791; Y10T 24/40; Y10T 24/45696
USPC ..... 24/186, 171, 179, 181, 188, 190, 614, 24/615, 629
See application file for complete search history.

(56) References Cited

U.S. PATENT DOCUMENTS

| | | | | | |
|---|---|---|---|---|---|
| 4,035,877 | A * | 7/1977 | Brownson | A44B 11/263 | 24/171 |
| 4,093,271 | A * | 6/1978 | Weigl | A63C 9/002 | 24/606 |
| 4,425,689 | A * | 1/1984 | Fildan | A44B 11/263 | 24/616 |
| 4,802,262 | A * | 2/1989 | Kasai | A44B 11/263 | 24/606 |
| 4,866,819 | A * | 9/1989 | Kasai | A44B 11/263 | 24/614 |
| 4,914,789 | A * | 4/1990 | Pedersen | B65D 33/1625 | 24/30.5 S |
| 4,928,364 | A * | 5/1990 | Ikeda | A44B 11/2592 | 24/171 |
| 5,516,114 | A * | 5/1996 | Michlin | A63F 9/0278 | 24/30.5 S |
| 5,551,131 | A * | 9/1996 | Anscher | A44B 11/263 | 24/606 |

(Continued)

*Primary Examiner* — Robert Sandy
*Assistant Examiner* — Rowland Do
(74) *Attorney, Agent, or Firm* — Troutman Sanders LLP; John A. Morrissett

(57) ABSTRACT

A pull and release latch including a releasable lock featuring stress preventers and a limit stop. The limit stop prevents the releasable lock from cantilevering too much to the point of breaking or stressing the releasable lock. A unique design allows a male component and a female component to be easily engaged while at the same time the pulling force to release the lock gives the same motion to separate the two components in a direction perpendicular to a cantilever axis.

14 Claims, 2 Drawing Sheets

(56) References Cited

U.S. PATENT DOCUMENTS

| | | | | | |
|---|---|---|---|---|---|
| 5,752,298 | A * | 5/1998 | Howell | A42B 3/166 | 2/418 |
| 5,784,765 | A * | 7/1998 | Fildan | A41C 3/0028 | 24/615 |
| 5,832,573 | A * | 11/1998 | Howell | A44B 11/2526 | 24/616 |
| 5,855,057 | A * | 1/1999 | Anscher | A44B 11/263 | 24/614 |
| 6,637,083 | B1 * | 10/2003 | Howell | A44B 11/263 | 24/614 |
| 6,678,925 | B1 * | 1/2004 | Howell | A44B 11/2592 | 24/647 |
| 6,965,231 | B1 * | 11/2005 | Cinoglu | A61B 5/0555 | 324/300 |
| 7,100,251 | B2 * | 9/2006 | Howell | A44B 11/263 | 24/602 |
| 7,155,786 | B2 * | 1/2007 | Grimm | A44B 11/2592 | 24/647 |
| 7,322,073 | B2 * | 1/2008 | Cuisinier | A44B 99/00 | 24/30.5 S |
| 8,181,318 | B2 * | 5/2012 | Anscher | A44B 11/2592 | 24/634 |
| 8,464,406 | B2 * | 6/2013 | Anscher | A44B 11/263 | 24/163 R |
| 2004/0221432 | A1 * | 11/2004 | Nezu | A44B 11/263 | 24/614 |
| 2008/0263836 | A1 * | 10/2008 | Howell | A44B 11/2592 | 24/614 |

* cited by examiner

PULL AND RELEASE LATCH

TECHNICAL FIELD

This latch pertains to those latches that are quick release by pulling on a string and pulling on one of the two components to separate from one another. The latch is used to detachably connect straps together, in particular, straps used to assemble or disassemble a bulletproof vest from a person's body.

BACKGROUND OF THE INVENTION

A known latch is shown in FIGS. 6-8. It shows a latch 30 where the direction of removal of one of the components is along a cantilever axis A1 of an engagement lock 31*c*. This type of latch requires two steps to separate the two components 31, 41 making this type of latch cumbersome. The first step is to pull on a string, not shown, in one direction to disengage the engagement lock 31*c*. Thereafter, one has to pull the disengaged component 31 in a direction along the cantilever axis A1 thus adding another step and applying separate forces to fully separate the two components 31, 41. The prior art latch also features a limit block 31*a* and limit stop 31*b* so the disengagement lock 31*c* is limited in cantilever motion thus preventing breakage. While latches have been known to latch components together and separate by either pulling a string, the invention does not seek to cover this aspect of pulling a lock with a string.

Another well-known latch is that found in backpacks where one has to press tabs to release. The direction of pressing is perpendicular to the cantilever axis and having the separation of the two components of the latch going perpendicular to the cantilever axis.

SUMMARY OF THE INVENTION

One aspect of the present invention is a quick release latch comprising female and male components that engage with each other. The female and male components integrate notches for attaching removable straps. Another aspect of the present invention allows for a user to separate the components apart by merely pulling a string or cord attached to a cantilever wall of the female component thus disengaging the components by the same force applied to the string to disengage a catch of the cantilever wall. The same force applied to the string translates into the motion of the female component causing separation from the male component.

Another aspect of the present invention is the integration of a stronger limit stop and a guiding feature that allows the male component to be guided into proper engagement in the female component. A further aspect is the inclusion of stress relievers to extend the life of the cantilever wall.

DETAILED DESCRIPTION OF THE DRAWINGS

Figure 1:
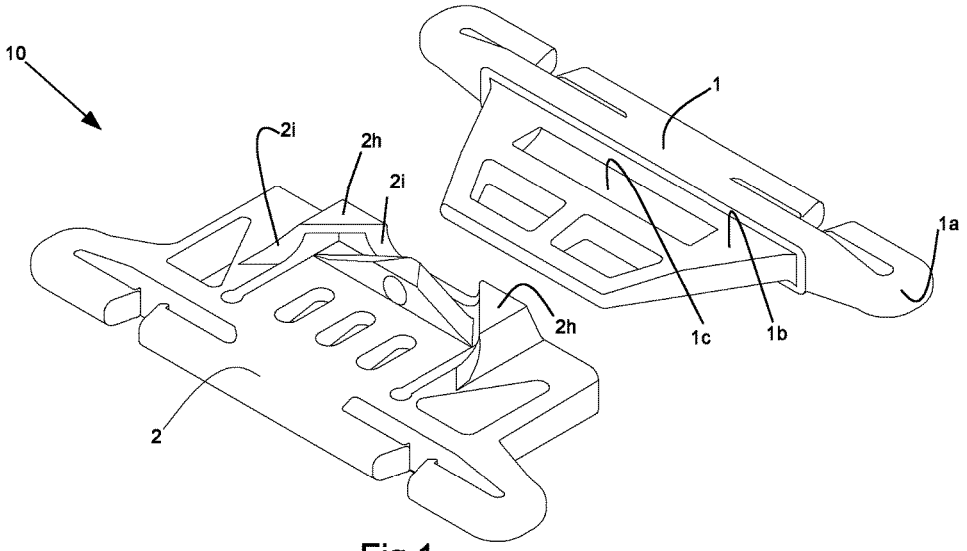
FIG. 1 is a perspective view of a pull-and-release latch in accordance with a first variation of the present invention.
Figure 2:
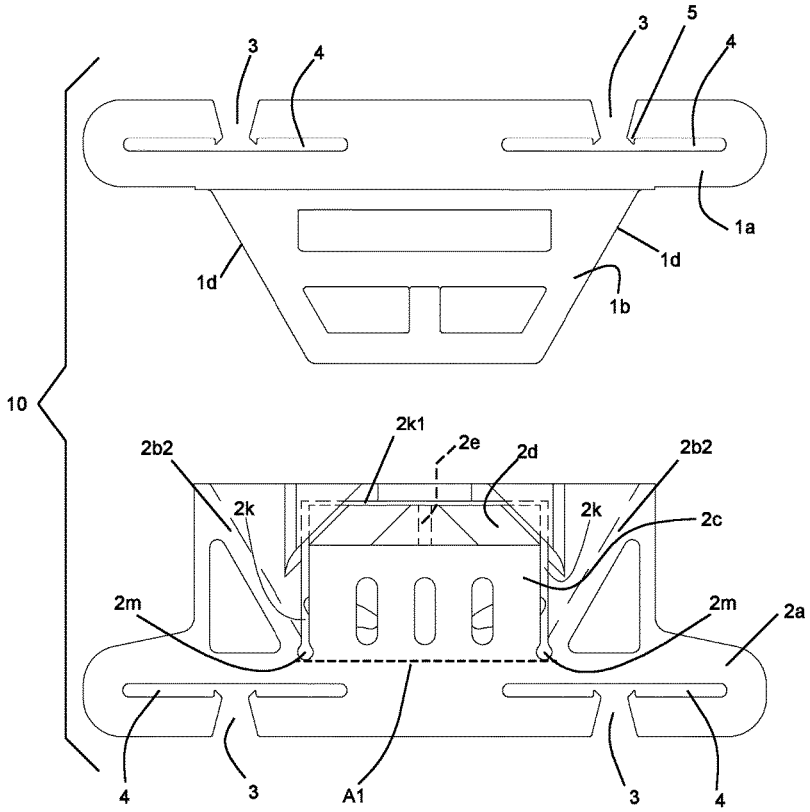
FIG. 2 is a top view of the latch shown in FIG. 1.
Figure 3:
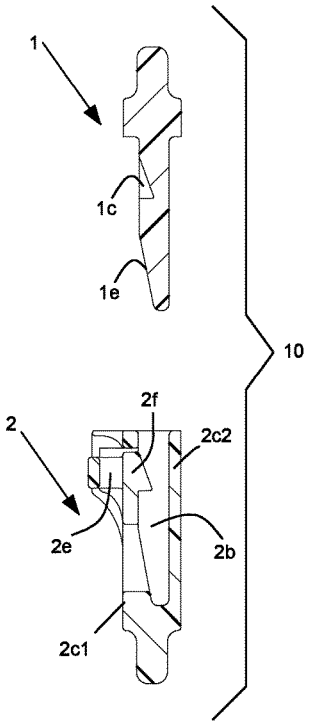
FIG. 3 is a cross-sectional view of the latch shown in FIG. 2 showing section 3-3.

With reference to FIGS. 1 and 2, a quick release latch 10 in accordance with the present invention is shown. The latch 10 comprises a female component 2 and a male component 18. Each of the components 1, 2 carries a pair of hooks 1*a*, 2*a* to receive a strap, not shown. The female component 12 has a top wall 2*c*1, a bottom 2*c*2, and sidewalls 2*b*2 together forming a receiving compartment 2*b* as shown in FIG. 3. The sidewalls 2*b*2 are tapered to receive a projection 1*b* of the male component 1. The projection comprising a pair of tapered sidewalls 1*d* and a leading tapered wall 1*e*. The top wall 2*c*1 includes a cantilever wall 2*c*, which is spaced from a pair of axial slots 2*k* and a traverse slot 2*k*1. As shown in FIG. 2, the cantilever wall 2*c* is fixed at cantilever axis A1 where most stress occurs. To increase the fatigue life of the cantilever wall 2*c*, each of the axial slots 2*k* terminates with stress reliever holes 2*m*. The cantilever wall 2*c* carries an extension 2*d* projecting from the cantilever wall 2*c* where a string, rope, or the like, not shown, can be fitted in through hole 2*e* so that a user can pull the cantilever wall 2*c* to disengage the female component 2 from the male component 1.

Figure 4:
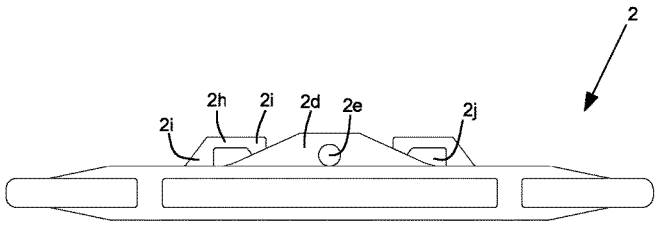
FIG. 4 is a sectional view of the assembled latch components.
Figure 5:
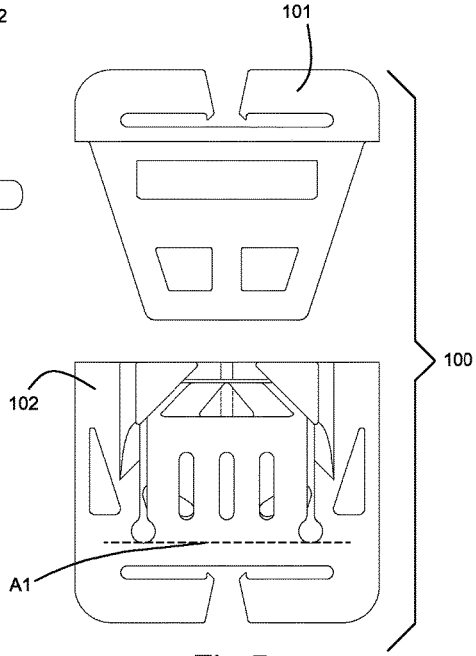
FIG. 5 is a front view in accordance with a second variation of the present invention.
Figure 8:
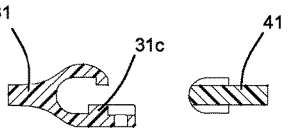
Prior Art Fig 8
FIG. 8 is a cross-section view showing section 8-8 in FIG. 7.
Figure 6:
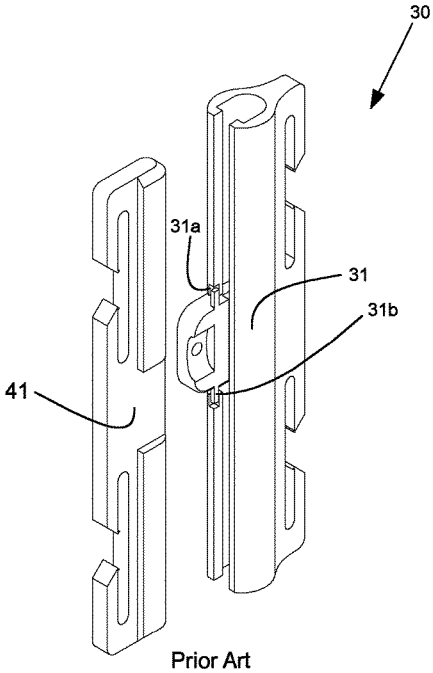
Prior Art Fig 6
FIG. 6 is a perspective view of a latch showing the prior art.
Figure 7:
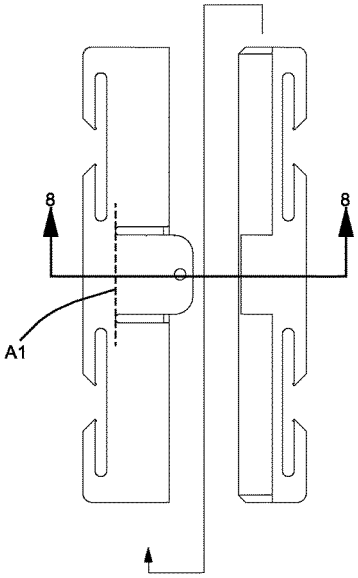
Prior Art Fig 7
FIG. 7 is a front view of the prior art latch shown in in FIG. 6.

As shown in FIGS. 1 and 3, the cantilever wall 2*c* carries a releasable lock 2*f* extending opposite to the extension 2*d*. The releasable lock 2*f* serves to catch into a corresponding cavity 1*c* on the tapered projection 1*b* of the male component 1. The leading tapered wall 1*e* of the male component 1 serves to push the lock 2*f* away thus allowing the lock 2*f* to easily engage the cavity 1*c*. To prevent overstressing the cantilever wall 2*c*, the latch 10 is equipped with a motion stop 2*h*, which is spaced parallel to the top wall 2*c*1. A pair of anchors 2*i*, as shown in FIGS. 1 and 4, bridges the motion stop 2*h* and covers a corner section of the releasable lock 2*f*. It should be noted that one of the anchors 2*i* is parallel to the axial slots 2*k* and the other anchor 2*i* is parallel to the traverse slot 2*k*1. These motions stops 2*h* prevent anyone pulling on the cantilever wall 2*c* from pivoting more than cantilever wall 2*c* would to avoid overstressing and breaking the cantilever wall 2*c*.

To separate the male and female components 1, 2, one will simply pull on the cantilever wall 2*c* via a string or rope, not shown. The pulling force on the female component 2 will separate the lock 2*f* from the cavity 1*c* thus disengaging the two components while the same pulling force transfers into separating the two components perpendicular to the cantilever axis A1. Of course, it should go without saying that for separation to occur, an anchor force opposite to the pulling force needs to take place for separation to occur. This would happen when the male component is anchored to a fixed point such as a bulletproof vest. When pulling on the female component 2, portions of the vest will become separated.

While the invention is envisioned to be used with belts or straps that fit on the hooks 1*a*, 2*a* by fitting the belt or strap through a mouth 3 leading to an opening 4, the hook 1*a*, 2*a* can be of any shape and size as long it hold a strap or belt. The mouth 3 includes biting hooks 5 that would bite into the strap or belt to prevent sliding out. The biting hooks 5 project into the opening 4. It is envisioned that one can just put one hook 1*a*, 2*a* as shown in the latch 100 shown in FIG.

5. In this second embodiment, the male 101 and female component 102 carry at least one hook similar in shape to that shown in FIGS. 1-4.

Other modification can be envisioned, in particular, one can utilize any know material to make the latch. In particular, a material that is flexible such as plastic, metal, or a combination thereof. The corresponding cavity 1*c* of the male components can be placed in opposite sides to make the male component 1 reversible. The male and female component can include material reduction through holes to reduce the weight. All edges can either be blended or rounded to increase strength or reduce sharp edges. While the application herein disclosed is to bulletproof vests, the latch can be applied to many applications requiring separation of two components.

The invention claimed is:

1. A latch comprising a male component and a female component;

the female component comprising a top wall, a bottom wall, and sidewalls forming a receiving compartment;

the top wall comprising a cantilever wall spaced from a pair of axial slots and a transverse slot;

wherein the cantilever wall extending on the same plane as that of the top wall;

wherein the female component comprises a releasable lock engageable with a corresponding shaped cavity of the male component, and wherein the female component includes at least one motion stop to limit the cantilever wall from flexing too much, and wherein the motion stop is parallel to the top wall and includes at least one anchor bridging the motion stop from the top wall and covering a section of the cantilever wall.

2. The latch of claim 1, wherein the cantilever wall further comprises an extension opposite to the releasable lock and wherein the extension further includes a through hole to string a cord or cable.

3. The latch of claim 1, wherein the male component comprises a front tapered wall to flex the releasable lock.

4. The latch of claim 1, wherein the motion stop is parallel to the top wall and includes two anchors bridging the motion stop from the top wall and covering a section of the cantilever wall; and, wherein one of the two anchors is parallel to the axial slots and the other anchor is parallel to the transverse slot.

5. The latch of claim 4, wherein the male and female components include at least one hook to receive a strap or belt.

6. The latch of claim 5, wherein the hook includes a mouth leading to an opening.

7. The latch of claim 6, wherein the mouth includes biting hooks projecting into the opening of the hooks.

8. A latch comprising a male component and a female component;

the female component comprising a top wall, a bottom wall, and sidewalls forming a receiving compartment;

the top wall comprising a cantilever wall spaced from a pair of axial slots and a transverse slot;

wherein the cantilever wall extending on the same plane as that of the top wall;

wherein the male component comprises tapered walls to be received on the receiving compartment having a corresponding shape;

wherein the female component comprises a releasable lock engageable with a corresponding shaped cavity of the male component;

wherein the female component includes at least one motion stop to limit the cantilever wall from flexing too much, wherein the cantilever wall defines a cantilever axis at an anchor point, and wherein the male component and female component being separable perpendicular to the cantilever wall.

9. The latch of claim 8, wherein the motion stop is parallel to the top wall and includes two anchors bridging the motion stop from the top wall and covering a section of the cantilever wall; and, wherein one of the two anchors is parallel to the axial slots and the other anchor is parallel to the transverse slot.

10. A latch comprising a male component and a female component;

the female component comprising a top wall, a bottom wall, and sidewalls forming a receiving compartment; and, the top wall comprising a cantilever wall spaced from a pair of axial slots and transverse slot;

wherein the female component comprises a releasable lock engageable with a cavity of the male component;

wherein the female component includes at least one motion stop to limit the cantilever wall from flexing too much;

wherein the motion stop is parallel to the top wall and includes two anchors bridging the motion stop from the top wall and covering a section of the cantilever wall; and, wherein one of the two anchors is parallel to the axial slots and the other anchor is parallel to the transverse slot.

11. The latch of claim 10, wherein the male and female components include at least one hook to receive a strap or belt.

12. The latch of claim 11, wherein the hook includes a mouth leading to an opening.

13. The latch of claim 12, wherein the mouth includes biting hooks projecting into the opening of the hooks.

14. A latch comprising a male component and a female component;

the female component comprising a cantilever wall spaced from a pair of axial slots and a transverse slot;

wherein the male component comprises tapered walls to be received on the receiving compartment having a corresponding shape;

wherein the female component comprises a releasable lock engageable with a cavity of the male component; and, wherein the female component includes at least one motion stop to limit the cantilever wall from flexing too much;

wherein the motion stop is parallel to the top wall and includes two anchors bridging the motion stop from the top wall and covering a section of the cantilever wall; and, wherein one of the two anchors is parallel to the axial slots and the other anchor is parallel to the transverse slot.

* * * * *